US010914258B2

(12) United States Patent
Usui et al.

(10) Patent No.: US 10,914,258 B2
(45) Date of Patent: Feb. 9, 2021

(54) CONTROL APPARATUS FOR HYBRID VEHICLE

(71) Applicant: TOYOTA JIDOSHA KABUSHIKI KAISHA, Toyota (JP)

(72) Inventors: Kunihiko Usui, Fuji (JP); Yusuke Suzuki, Hadano (JP); Koji Miwa, Sunto-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 36 days.

(21) Appl. No.: 16/288,810

(22) Filed: Feb. 28, 2019

(65) Prior Publication Data

US 2019/0301385 A1 Oct. 3, 2019

(30) Foreign Application Priority Data

Apr. 2, 2018 (JP) ..... 2018-070965

(51) Int. Cl.
*F02D 41/04* (2006.01)
*F02D 41/38* (2006.01)

(52) U.S. Cl.
CPC ..... *F02D 41/042* (2013.01); *F02D 41/3836* (2013.01); *F02D 2041/389* (2013.01); *F02D 2200/0602* (2013.01); *F02D 2200/501* (2013.01); *F02D 2250/31* (2013.01)

(58) Field of Classification Search
CPC ..... F02D 41/042; F02D 41/3836; F02D 2041/389; F02D 2200/0602; F02D 2200/501; F02D 2250/31
See application file for complete search history.

(56) References Cited

U.S. PATENT DOCUMENTS

2001/0042535 A1 11/2001 Yamazaki et al.
2006/0207567 A1 9/2006 Yamaguchi et al.

FOREIGN PATENT DOCUMENTS

JP 2001-317389 A 11/2001
JP 2006-258032 A 9/2006
JP 2009-114922 A 5/2009
JP 2010-127092 A 6/2010
JP 2012-132360 A 7/2012
JP 2014-218972 A 11/2014

*Primary Examiner* — Hung Q Nguyen
*Assistant Examiner* — Mark L. Greene
(74) *Attorney, Agent, or Firm* — Oliff PLC

(57) ABSTRACT

A fuel supply apparatus is operated so as to increase an upon-stopping fuel pressure in accordance with an increase in an upon-stopping vehicle speed, the upon-stopping fuel pressure being a fuel pressure in a state in which an internal combustion engine is intermittently stopped, the upon-stopping vehicle speed being a vehicle speed upon intermittently stopping the internal combustion engine.

4 Claims, 5 Drawing Sheets

CONTROL APPARATUS FOR HYBRID VEHICLE

CROSS-REFERENCE TO RELATED APPLICATION

The present application claims priority under 35 U.S.C. § 119 to Japanese Patent Application No. 2018-070965, filed Apr. 2, 2018. The contents of this application are incorporated herein by reference in their entirety.

BACKGROUND

Field

The present disclosure relates to a control apparatus for a hybrid vehicle which includes an internal combustion engine having a direct injection injector.

Background

JP 2001-317389 A discloses the conventional art relating to automatic stopping of an internal combustion engine having a direct injection injector.

In this conventional art, by raising a fuel pressure on a side of the direct injection injector of a fuel pump immediately before the automatic stopping, a fuel pressure required for compression stroke injection upon restarting is secured.

SUMMARY

Although the above-mentioned conventional art is based on the conventional engine vehicle, instead of a hybrid vehicle, automatic stopping/automatic starting of the internal combustion engine is performed also in the hybrid vehicle which runs while the internal combustion engine is intermittently stopped. However, the restarting of the internal combustion engine in the conventional engine vehicle is performed when a vehicle speed is low, whereas the restarting thereof in the hybrid vehicle is performed under various vehicle speed conditions from a state in which the internal combustion engine is intermittently stopped.

A load required for the internal combustion engine varies depending on a vehicle speed upon staring the internal combustion engine. When the vehicle speed is low upon the starting, operation with a low or medium load required therefor is predicted after the starting, whereas when the vehicle speed upon the staring is high, operation with a high load required therefor is predicted after the starting. In order to secure startability of the internal combustion engine by promoting atomization of fuel, it is preferable that the fuel pressure upon the starting is high. However, upon the operation with the high load required therefor, fuel spray is prevented by a strong flow current formed inside each cylinder from reaching a piston top face, whereas upon the operation with the low or medium load required therefor, a penetration force of the fuel spray causes the fuel to easily adhere to the piston top face because a flow current formed inside each cylinder is weak. Therefore, depending on relationship between the load and the fuel pressure, a particulate matter (PM) emission amount is likely to be increased due to an increase in piston wet.

The present disclosure has been devised in view of the above-mentioned problem, and an object of an example in the present disclosure is to provide a control apparatus which is capable of suppressing generation of PM in a hybrid vehicle which includes an internal combustion engine having a direct injection injector while securing startability by fuel spray from a direct injection injector upon starting the internal combustion engine from a state in which the internal combustion engine is intermittently stopped.

A control apparatus for a hybrid vehicle according to an example in the present disclosure is included in a hybrid vehicle which includes: an internal combustion engine having a direct injection injector; and a fuel supply apparatus generating a fuel pressure for fuel supplied to the direct injection injector in accordance with an operation state of the internal combustion engine. The control apparatus is capable of starting, by injecting the fuel from the direct injection injector, the internal combustion engine from a state in which the internal combustion engine is intermittently stopped. In order to achieve the above-mentioned object, the control apparatus for a hybrid vehicle according to the example of the present disclosure, is configured to operate the fuel supply apparatus so as to increase an upon-stopping fuel pressure in accordance with an increase in an upon-stopping vehicle speed, the upon-stopping fuel pressure being a fuel pressure in the state in which the internal combustion engine is intermittently stopped, the upon-stopping vehicle speed being a vehicle speed upon intermittently stopping the internal combustion engine.

By the control apparatus configured as described above, upon intermittently stopping the internal combustion engine in a high vehicle speed range in which high load operation is predicted immediately after restarting, the upon-stopping fuel pressure is increased, thereby allowing the generation of PM to be suppressed while the startability upon restarting is secured through promotion of atomization of the fuel. By the control apparatus configured as described above, upon intermittently stopping the internal combustion engine in a low vehicle speed range in which low or medium load operation is predicted immediately after restarting, the upon-stopping fuel pressure is relatively lowered, thereby decreasing a penetration force of the fuel spray and allowing the piston wet to be suppressed. Thus, the generation of PM stemming from the piston wet can be suppressed.

A lowest fuel pressure may be set for the upon-stopping fuel pressure. The lowest fuel pressure may be, for example, a minimum value in a range of fuel pressures in which the startability of the internal combustion engine can be secured and an amount of PM generated upon starting can be suppressed to be in an allowable range. In this case, when the upon-stopping vehicle speed is less than or equal to a predetermined vehicle speed, the control apparatus for a hybrid vehicle may be configured to operate the fuel supply apparatus such that the upon-stopping fuel pressure becomes the lowest fuel pressure, and when the upon-stopping vehicle speed is higher than the predetermined vehicle speed, the control apparatus for a hybrid vehicle according to the embodiment of the present invention may be configured to operate the fuel supply apparatus such that the upon-stopping fuel pressure is increased so as to be higher than the lowest fuel pressure in accordance with an increase in a degree to which the upon-stopping vehicle speed is higher than the predetermined vehicle speed. When the upon-stopping vehicle speed is less than or equal to the predetermined vehicle speed, the upon-stopping fuel pressure is not made lower than the lowest fuel pressure, the startability of the internal combustion engine can be prevented from being reduced due to deterioration in atomization of the fuel and a PM emission amount can be prevented from being increased.

The fuel supply apparatus may be configured to change a fuel pressure in accordance with a provided designated fuel pressure. In this case, the control apparatus for a hybrid vehicle may be configured to obtain an actual fuel pressure in the state in which the internal combustion engine is intermittently stopped, and when there is a difference between a target value of the upon-stopping fuel pressure and the actual fuel pressure, the control apparatus for a hybrid vehicle may be configured to correct the designated fuel pressure so as to bring the actual fuel pressure close to the target value. This allows the actual fuel pressure in the state in which the internal combustion engine is intermittently stopped to be brought close to the target value even when the fuel supply apparatus has aged deterioration and individual variability.

The fuel supply apparatus may include a fuel pump driven by the internal combustion engine. However, after the internal combustion engine has been in the intermittently stopped state, the fuel pump driven by the internal combustion engine cannot raise the fuel pressure. In this case, the control apparatus for a hybrid vehicle may be configured to stop the internal combustion engine upon intermittently stopping the internal combustion engine, after having raised a fuel pressure up to the upon-stopping fuel pressure from a fuel pressure in a state in which the internal combustion engine is idling. By having raised the fuel pressure before stopping the internal combustion engine, even the fuel pump driven by the internal combustion engine can obtain an appropriate upon-stopping fuel pressure.

As described above, upon starting the internal combustion engine from the state in which the internal combustion engine is intermittently stopped, the control apparatus for a hybrid vehicle according to the example in the present disclosure is capable of suppressing the generation of PM while securing the startability attained by the injection of the fuel from the direct injection injector.

DESCRIPTION OF EMBODIMENTS

Hereinafter, with reference to the accompanying drawings, embodiments of the present disclosure will be described. In the embodiments described below, when a number such as a number of pieces, a quantity, an amount, and a range of components is mentioned, except when that number is expressly stated and when that number is specified as a number clarified in principle, the present disclosure is not limited to that mentioned number. In addition, a configuration, steps, and the like explained in the below-described embodiments are not necessarily essential to the present disclosure, except when expressly stated and when specified as clarified one and ones in principle.

1. Configuration of Hybrid Vehicle

Figure 1:
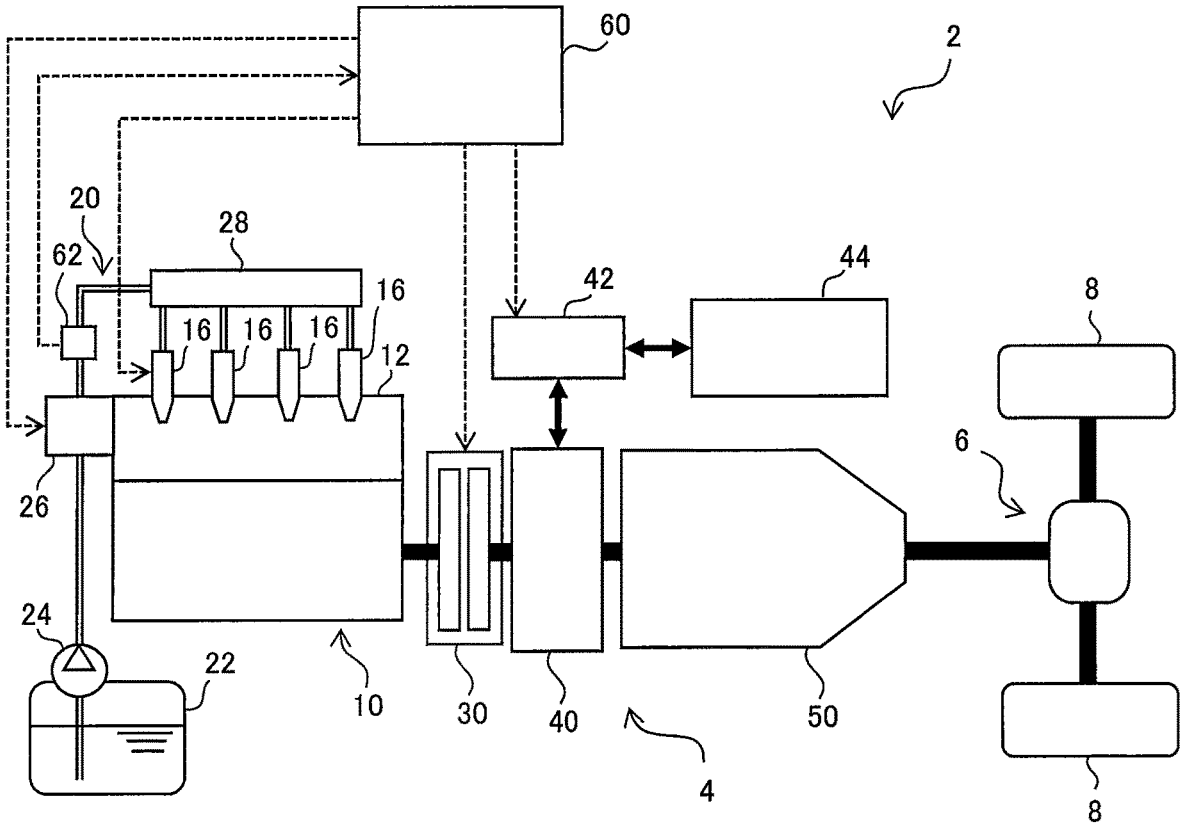
FIG. 1 is a diagram illustrating a configuration of a hybrid vehicle according to an embodiment of the present disclosure.

FIG. 1 is a diagram illustrating a configuration of a hybrid vehicle 2 according to the present embodiment. The hybrid vehicle 2 includes a hybrid system 4 as a power train. The hybrid system 4 is connected to wheels 8 via a driving force transmission system 6 including axles and a differential. The hybrid system 4 according to the present embodiment is the so-called parallel hybrid system. The hybrid system 4 includes an engine 10 and a motor 40 as power apparatuses. The engine 10 is connected to an input shaft of an automatic transmission 50 via a clutch apparatus 30. The motor 40 is coupled to the input shaft of the automatic transmission 50.

The engine 10 is an internal combustion engine which outputs power through combustion of hydrocarbon-based fuel such as gasoline or light oil. The engine 10 is configured as a direct injection engine which directly injects the fuel into an inside of a combustion chamber. Therefore, a cylinder head 12 of the engine 10 is provided with direct injection injectors 16 attached to respective cylinders. Except that the direct injection injectors 16 are included, the configuration of the engine 10 is not particularly limited. In other words, the engine 10 may be configured as a spark ignition type engine and may be configured as a diesel engine.

The engine 10 is provided with a fuel supply apparatus 20 which supplies the fuel to the direct injection injectors 16. The fuel supply apparatus 20 is configured to generate a fuel pressure to the fuel supplied to the direct injection injectors 16 in accordance with an operation state of the engine 10. More specifically, the fuel supply apparatus 20 includes at least: a fuel tank 22 with the fuel stored; an electrically operated low pressure fuel pump 24 for pumping the fuel from an inside of the fuel tank 22; an engine-driven high pressure fuel pump 26 for pressurizing the fuel pumped by the low pressure fuel pump 24; and a common rail 28 for storing the high pressure fuel pressurized by the high pressure fuel pump 26. The high pressure fuel stored in the common rail 28 is supplied to the direct injection injectors 16. In a fuel supply line downstream of the high pressure fuel pump 26, a fuel pressure sensor 62 is attached.

The motor 40 is an AC synchronous generator motor having both of a function as an electric motor for outputting a torque by supplied electricity and a function as a generator for converting input mechanical power to electricity. The motor 40 transmits and receives the electricity to and from a battery 44 via an inverter 42. When the motor 40 functions as the electric motor, electricity consumed by the motor 40 is supplied from the battery 44 via the inverter 42. When the motor 40 functions as the generator, electricity generated by the motor 40 is charged in the battery 44 via the inverter 42.

The hybrid vehicle 2 includes a control apparatus 60 for controlling traveling of the hybrid vehicle 2 by controlling operation of the hybrid system 4. The control apparatus 60 is an electronic control unit (ECU) having at least one processor, at least one memory, and input/output ports. Detection signals are input to the input port from various sensors including the fuel pressure sensor 62. Operation signals for various devices including the high pressure fuel pump 26 are output from the output port. The memory has stored therein a variety of pieces of data including various programs and maps for controlling the traveling of the hybrid vehicle 2. The programs stored in the memory are executed by the processor, thereby realizing various functions in the control apparatus 60. The control apparatus 60 may be configured by a plurality of ECUs.

When the hybrid vehicle 2 is caused to perform motor traveling, the control apparatus 60 disconnects the clutch apparatus 30 and controls the hybrid system 4 so as to cause the motor 40 to function as the electric motor while the engine 10 is intermittently stopped. The control for the motor 40 is performed via the inverter 42. When traveling of the hybrid vehicle 2 is switched from the motor traveling to engine traveling (traveling only by the engine 10 or traveling by the engine 10 and the motor 40), the control apparatus 60 connects the clutch apparatus 30, transmits a torque of the motor 40 to the engine 10 via the clutch apparatus 30, and starts the engine 10 by starting fuel injection control through operation of the direct injection injectors 16.

2. Upon-Stopping Fuel Pressure Control by Control Apparatus

In the control of the hybrid system 4 by the control apparatus 60, fuel pressure control by operation of the fuel supply apparatus 20 is included. In particular, fuel pressure control performed upon intermittently stopping the engine 10 is characteristic control by the control apparatus 60. Hereinafter, this fuel pressure control is referred to as upon-stopping fuel pressure control. First, with reference to FIG. 2 and FIG. 3, setting of a target fuel pressure in the upon-stopping fuel pressure control will be described.

Figure 2:
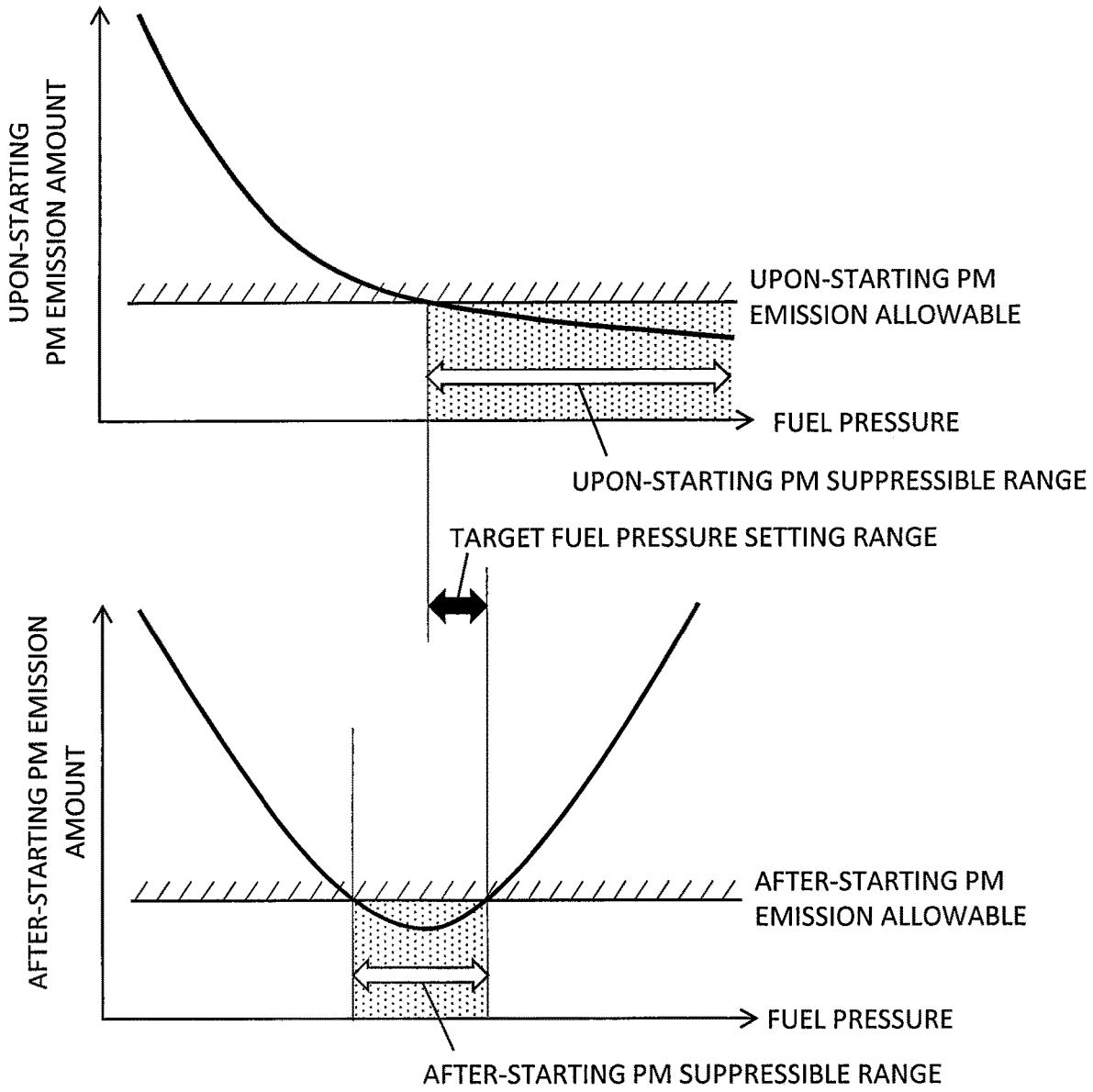
FIG. 2 shows graphs illustrating a setting range of target fuel pressures when a load is low or medium.
Figure 3:
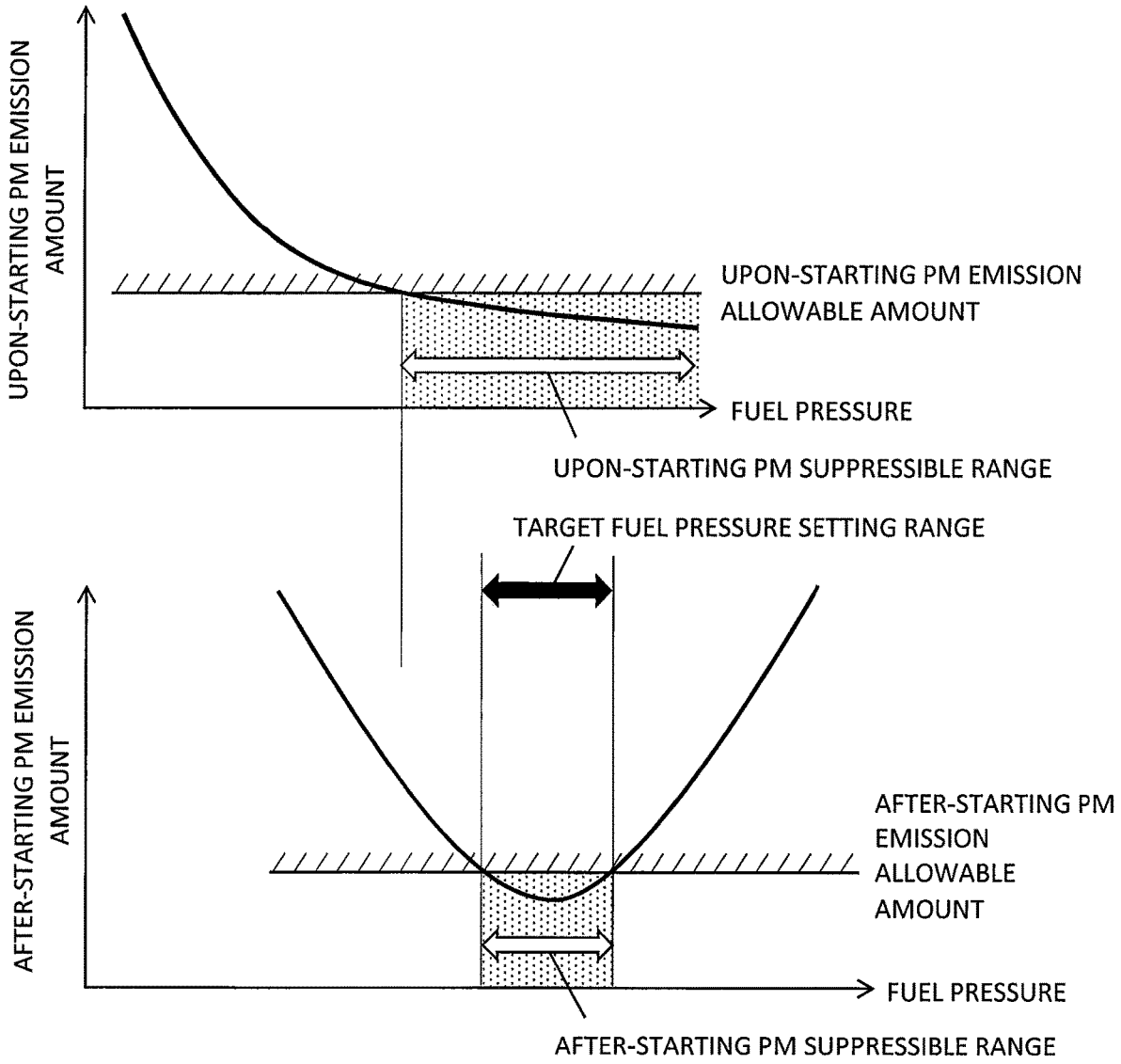
FIG. 3 shows graphs illustrating a setting range of target fuel pressures when a load is high.

An upper graph in FIG. 2 and an upper graph in FIG. 3 are the same as each other. Each of these graphs shows relationship between a PM emission amount and a fuel pressure upon starting the engine 10 in a state in which the engine 10 is an intermittently stopped state. The "PM emission amount" means a PM amount per unit time discharged from the combustion chamber of the engine 10. In addition, in the present embodiment, the "upon starting" is defined as a period up to when the engine 10 has caused explosion a predetermined number of times (for example, a period up to when the engine 10 has caused the explosion six times). The "upon starting" may be defined as a period up to when a number of revolutions of the engine 10 has risen up to a predetermined number of revolutions.

When a fuel pressure is high, atomization of fuel injected from the direct injection injectors 16 is promoted. However, when the fuel pressure is low, the fuel is not sufficiently atomized. The more insufficient the atomization of the fuel is, the larger an upon-starting PM emission amount becomes. Therefore, as shown in the graphs, although when the fuel pressure is high, the upon-starting PM emission amount can be suppressed to be low, in accordance with a decrease in the fuel pressure, the upon-starting PM emission amount rapidly increases. An "upon-starting PM emission allowable amount" shown in each of the graphs is a PM emission amount allowed by, for example, laws and regulations relevant to exhaust performance. An "upon-starting PM suppressible range" shown in each of the graphs is a range of fuel pressures in which the upon-starting PM emission amount can be suppressed to be less than or equal to the allowable amount.

In addition, a degree to which the fuel injected from the direct injection injectors 16 is atomized upon starting also exerts influence on startability of the engine 10. If the fuel is not sufficiently atomized, the startability of the engine 10 cannot be secured. Consequently, the fuel pressure upon starting is required to be a fuel pressure at which the upon-starting PM emission amount can be suppressed to be less than or equal to the allowable amount and the startability of the engine 10 can be secured. In general, a fuel pressure within the "upon-starting PM suppressible range" allows the startability of the engine 10 to be secured.

Each of a lower graph in FIG. 2 and a lower graph in FIG. 3 shows relationship between a PM emission amount and a fuel pressure after starting the engine 10 when the engine 10 in the intermittently stopped state is started. The relationship shown in the lower graph in FIG. 2 is relationship with a load of the engine 10 being low or medium, and the relationship shown in the lower graph in FIG. 3 is relationship with a load of the engine 10 being high. In addition, in the present embodiment, the "after starting" is defined as a period after the period included in the "upon starting". Specifically, the "after starting" is defined as a period after the engine 10 has caused the explosion the predetermined number of times (for example, the engine 10 has caused the explosion six times). The "after starting" may be defined as a period after a number of revolutions of the engine 10 has risen up to a predetermined number or more of revolutions.

Also after starting the engine 10, as upon starting the engine 10, if a fuel pressure is low, deterioration in the atomization of the fuel increases the PM emission amount. However, after starting the engine 10, the PM emission amount does not monotonically decrease in response to an increase in the fuel pressure, and when the fuel pressure is equal to or greater than a certain magnitude, the PM emission amount increases in accordance with an increase in the fuel pressure. In other words, in response to the increase in the fuel pressure, the PM emission amount changes in a downward convex parabolic manner. This is because in accordance with the increase in the fuel pressure, a penetration force of fuel spray increases and causes the fuel to easily adhere to a piston top face. In accordance with the increase in the fuel adhering to the piston top face, that is, piston wet, an amount of PM generated by desorption of the piston wet also increases. Although the piston wet is generated also upon starting the engine 10, because an amount of deposited piston wet itself is small, the amount of PM generated by the desorption of the piston wet is also small. Therefore, upon starting the engine 10, influence exerted by the piston wet on the PM emission amount is small, even with the fuel pressure being high, the PM emission amount can be suppressed.

An "after-starting PM emission allowable amount" shown in each of a lower graph in FIG. 2 and a lower graph in FIG. 3 is a PM emission amount allowed by, for example, the laws and regulations relevant to the exhaust performance. An "after-starting PM suppressible range" shown in each of the graphs is a range of fuel pressures in which an after-starting PM emission amount can be suppressed to be less than or equal to the allowable amount. When the two graphs are compared with each other, it is seen that an after-starting PM suppressible range with a high load ranges over a range of higher fuel pressures than fuel pressures of an after-starting PM suppressible range with a low or medium load. This means that when the load after starting the engine 10 is high, fuel pressures can be set to be high, as compared with when the load after starting the engine 10 is low or medium.

When the load after starting the engine 10 is high, because of high charging efficiency, a strong flow current is formed inside each of the cylinders. Since this strong flow current prevents the fuel spray from reaching the piston top face, when the load is high, even with comparatively high fuel pressures, the piston wet hardly increases. Therefore, when the load is high, even with the comparatively high fuel pressure, the PM emission amount can be suppressed to be less than or equal to the allowable amount. In contrast to this, when the load is low or medium, because of low charging efficiency, flow current formed inside each of the cylinders is weak, and the penetration force of the fuel spray causes the fuel to easily adhere to the piston top face. Consequently, when the load is low or medium, unless the fuel pressures are comparatively low, the PM emission amount cannot be suppressed to be less than or equal to the allowable amount. For the above-described reason, the PM suppressible range after starting the engine 10 with the high load ranges over the range of higher fuel pressures than the fuel pressures of the PM suppressible range after starting the engine 10 with the low or medium load.

Target fuel pressures are set in a range of fuel pressures in which upon starting the engine 10, the PM emission amount can be suppressed to be less than or equal to the allowable amount and also after starting the engine 10, the PM emission amount can be suppressed to be less than or equal to the allowable amount. Hereinafter, this range of fuel pressures is referred to as a target fuel pressure setting range. The target fuel pressure setting range is a range in which the upon-starting PM suppressible range and the after-starting PM suppressible range overlap each other.

Although the upon-starting PM suppressible range is not influenced by the load after starting the engine 10, the after-starting PM suppressible range is changed by the load after starting the engine 10 as described above. Consequently, the target fuel pressure setting range is changed by the load after starting the engine 10. When the load after starting the engine 10 is low or medium, as shown in FIG. 2, a range from a lower limit value in the upon-starting PM suppressible range to an upper limit value in the after-starting PM suppressible range becomes the target fuel pressure setting range. On the other hand, when the load after starting the engine 10 is high, as shown in FIG. 3, the after-starting PM suppressible range becomes the target fuel pressure setting range as it is.

In the present embodiment, the "low or medium load" is defined as a load with which a lower limit value in the after-starting PM suppressible range becomes lower than the lower limit value in the upon-starting PM suppressible range. In addition, in the present embodiment, the "high load" is defined as a load with which the lower limit value in the after-starting PM suppressible range becomes equal to or greater than the lower limit value in the upon-starting PM suppressible range. As specific examples of a load in the boundary between the low or medium load and the high load, when the engine is a supercharged engine, a load of approximately 70% indicated as a charging efficiency is cited, and when the engine is a naturally aspirated engine, a load of approximately 50% indicated as a charging efficiency is cited.

It is only required for the target fuel pressure to be within the target fuel pressure setting range and any target fuel pressure therewithin may be set. However, when top priority is given to a fuel efficiency, a low target fuel pressure is preferable. This is because the higher a fuel pressure is made, the larger energy required for driving the high pressure fuel pump 26 is. In the present embodiment, a lower limit value in the target fuel pressure setting range is set as a target fuel pressure. In other words, upon starting the engine 10 and after starting the engine 10, a minimum fuel pressure at which the PM emission amount can be suppressed to be less than or equal to the allowable amount is set as the target fuel pressure. As described above, since the target fuel pressure setting range is changed depending on the load after starting the engine 10, a fuel pressure which should be set as the target fuel pressure is also determined in accordance with a load after starting the engine 10.

The control apparatus 60 operates the high pressure fuel pump 26 based on the set target fuel pressure. However, because a driving force is input to the high pressure fuel pump 26 from a camshaft of the engine 10, after the engine 10 has been stopped, the high pressure fuel pump 26 cannot generate a hydraulic pressure. In addition, the engine 10 stops after having undergone an idling state, and a fuel pressure in the idling state is lower than a lowest fuel pressure which allows the PM emission amount upon starting the engine 10 to be less than or equal to the allowable amount. Therefore, in the upon-stopping fuel pressure control, when the engine 10 has come to be in the idling state, the high pressure fuel pump 26 is operated to raise a fuel pressure from the fuel pressure in the idling state up to a target fuel pressure, and thereafter, the engine 10 is stopped. In other words, the target fuel pressure in the upon-stopping fuel pressure control is each of the target fuel pressures upon starting the engine 10 and after starting the engine 10 and at the same time, is also a target fuel pressure in a state in which the engine 10 is intermittently stopped. Hereinafter, the target fuel pressure in the upon-stopping fuel pressure control may be referred to as an upon-stopping target fuel pressure.

As described above, the minimum fuel pressure which allows the PM emission amount upon starting and after-starting to be suppressed to be less than or equal to the allowable amount is determined in accordance with a load after starting the engine 10. In order to set this fuel pressure as the upon-stopping target fuel pressure, it is required to predict, before stopping the engine 10, a load after starting from the state in which the engine 10 is intermittently stopped. When the hybrid system 4 operates in a steady control mode, a load on the engine 10 is in substantially one-to-one relationship with a vehicle speed. In addition, while the engine 10 is intermittently stopped, the vehicle speed does not change largely. Therefore, the control apparatus 60 obtains a vehicle speed of the hybrid vehicle 2 upon stopping the engine 10 and determines the upon-stopping target fuel pressure based on the vehicle speed.

Figure 4:
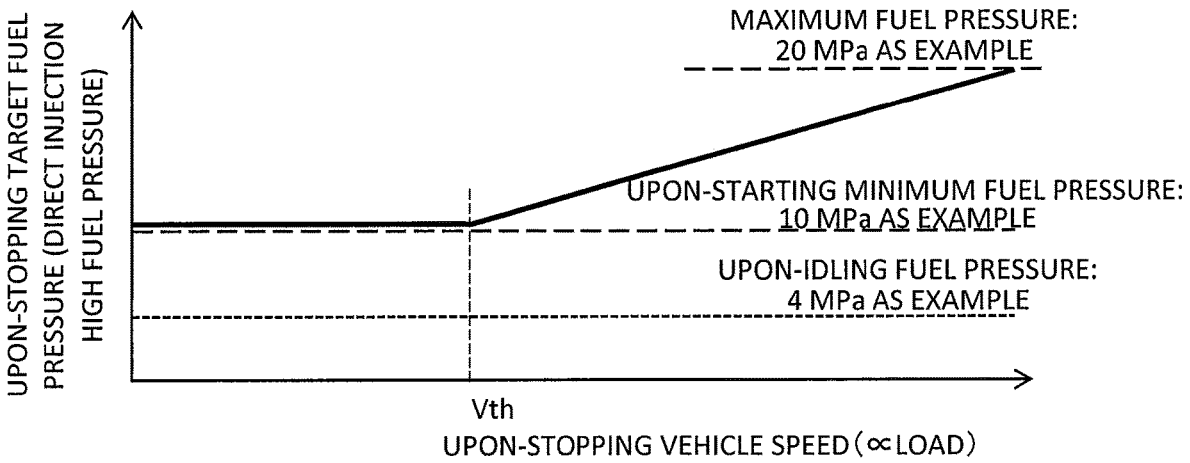
FIG. 4 is a graph showing one example of setting of an upon-stopping target fuel pressure with respect to an upon-stopping vehicle speed.

FIG. 4 is a diagram showing one example of setting of an upon-stopping target fuel pressure with respect to a vehicle speed upon stopping the engine 10 (hereinafter, referred to as an upon-stopping vehicle speed). When the upon-stopping vehicle speed is less than or equal to a predetermined vehicle speed Vth, the upon-stopping target fuel pressure is set to an upon-starting lowest fuel pressure. The upon-starting lowest fuel pressure is a lowest fuel pressure which allows the PM emission amount upon starting the engine 10 to be less than or equal to the allowable amount. The lower limit value in the upon-starting PM suppressible range shown in FIG. 2 is the upon-starting lowest fuel pressure. The predetermined vehicle speed Vth is a vehicle speed corresponding to a load in the boundary between the low or medium load and the high load. The upon-starting lowest fuel pressure is, for example, 10 MPa and is higher than a fuel pressure upon idling which is adjusted to be, for example, 4 MPa.

When the upon-stopping vehicle speed is higher than the predetermined vehicle speed Vth, the upon-stopping target fuel pressure is set to a fuel pressure so as to be higher than the upon-starting lowest fuel pressure in accordance with an increase in a degree to which the upon-stopping vehicle speed is higher than the predetermined vehicle speed Vth. The upon-stopping target fuel pressure which is set when the upon-stopping vehicle speed is higher than the predetermined vehicle speed Vth is a fuel pressure required to allow the PM emission amount after-starting the engine 10 to be less than or equal to the allowable amount. Hereinafter, this fuel pressure is referred to as an after-starting required fuel pressure. A lower limit value in the after-starting PM suppressible range shown in FIG. 3 is the after-starting required fuel pressure. The upon-stopping target fuel pressure is suppressed to be less than or equal to a maximum fuel pressure which is an allowable pressure of the whole of the fuel supply apparatus 20. The maximum fuel pressure is, for example, 20 MPa.

Figure 5:
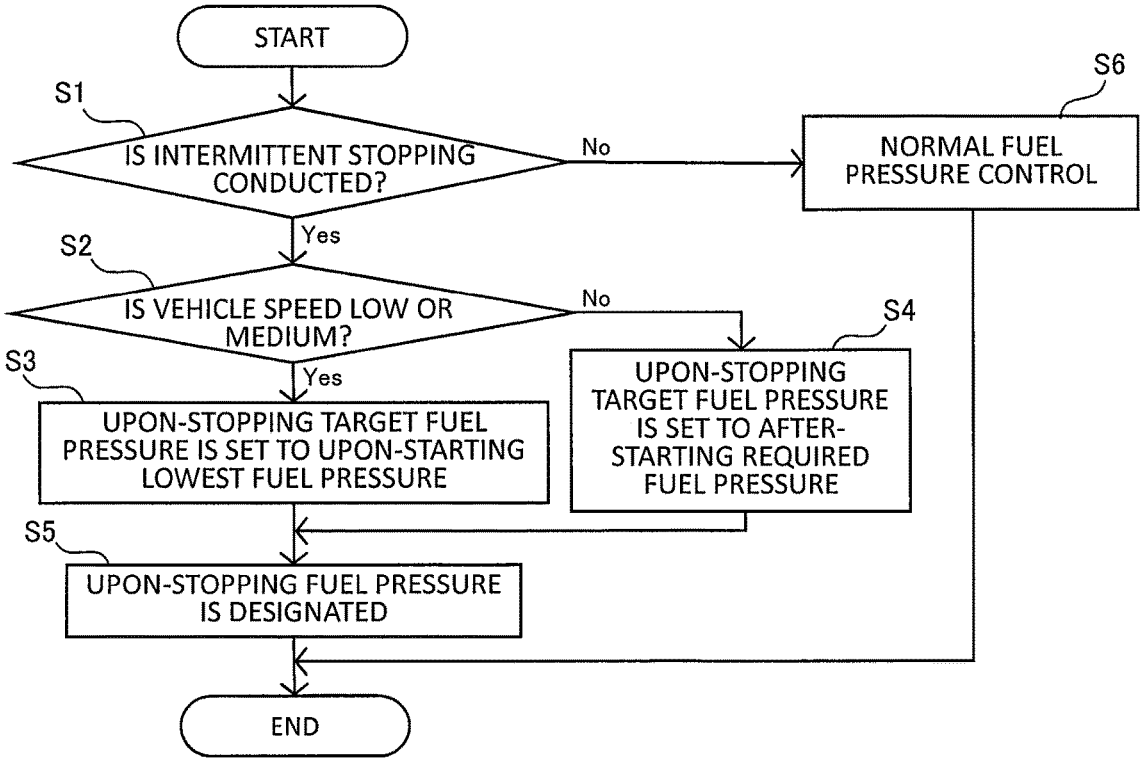
FIG. 5 is a flowchart illustrating a control flow of upon-stopping fuel pressure control.

The memory of the control apparatus 60 has stored therein a map which defines relationship between the upon-stopping vehicle speed and the upon-stopping target fuel pressure shown in FIG. 4. With reference to the map, the control apparatus 60 executes the upon-stopping fuel pressure control. FIG. 5 is a flowchart showing a control flow of the upon-stopping fuel pressure control executed by the control apparatus 60.

In the control flow of the upon-stopping fuel pressure control, first, at step S1, it is determined whether intermittent stopping of the engine 10 is conducted. For example, when a condition for causing the hybrid vehicle 2 to perform the motor traveling is satisfied, the engine 10 is intermittently stopped. When the intermittent stopping of the engine 10 is not conducted, at step S6, normal fuel pressure control based on an operation state of the engine 10 is performed. In the normal fuel pressure control, for example, in accordance with a load on the engine 10, a fuel pressure is adjusted.

When the intermittent stopping of the engine 10 is conducted, at step S2, it is determined whether a vehicle speed of the hybrid vehicle 2 is a low or medium vehicle speed, that is, whether the vehicle speed thereof is less than or equal to the predetermined vehicle speed Vth. When the upon-stopping vehicle speed is less than or equal to the predetermined vehicle speed Vth, at step S3, the upon-stopping target fuel pressure is set to the upon-starting lowest fuel pressure. When the upon-stopping vehicle speed is higher than the predetermined vehicle speed Vth, at step S4, the upon-stopping target fuel pressure is set to the after-starting required fuel pressure. At step S5, based on the upon-stopping target fuel pressure set at step S3 or step S4, an upon-stopping fuel pressure is designated for the high pressure fuel pump 26.

The designated fuel pressure for the high pressure fuel pump 26 is basically the same as a target fuel pressure. However, if the target fuel pressure is designated for the high pressure fuel pump 26 as it is, a difference between the target fuel pressure and an actual fuel pressure may be caused. For example, a leakage amount of the high pressure fuel pump 26 is changed by aged deterioration, and the aged deterioration may cause oil leakage from sealed portions and the direct injection injectors 16. Furthermore, even before the aged deterioration is caused, individual variability within a range of tolerance of the fuel supply apparatus 20 may cause a difference between the designated fuel pressure and the actual fuel pressure.

Figure 6:
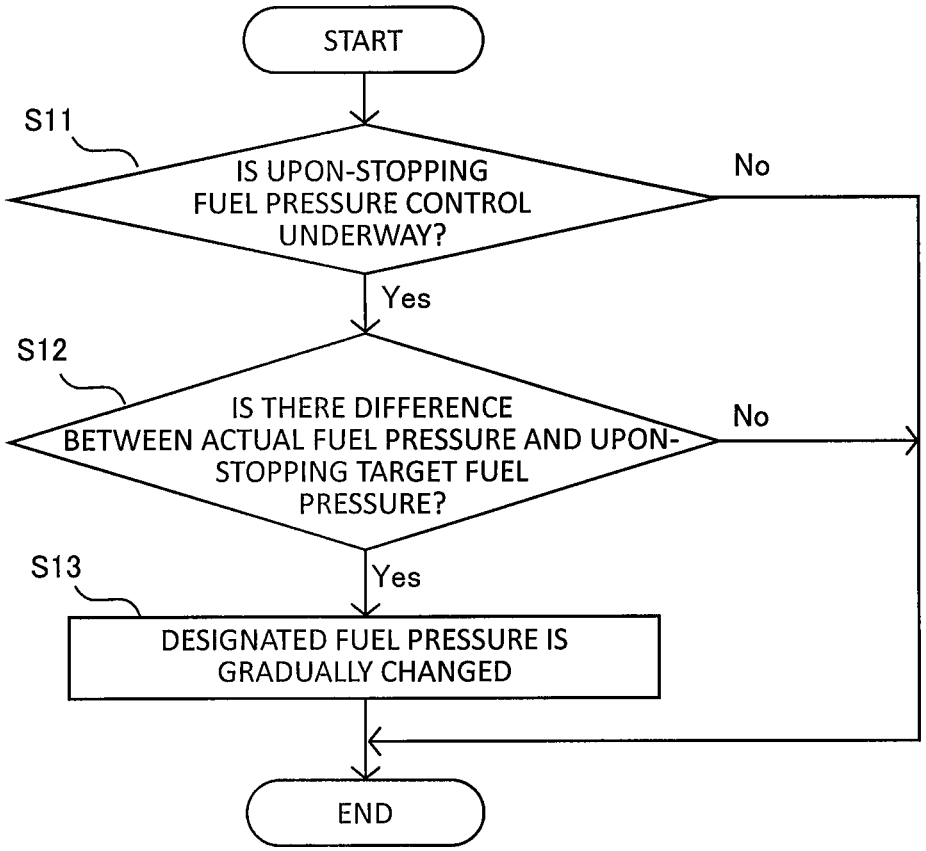
FIG. 6 is a flowchart illustrating a control flow of designated fuel pressure correction control.

In order to compensate the difference between the target fuel pressure and the actual fuel pressure, it is only required for the designated fuel pressure to be made larger or smaller than the target fuel pressure. For example, when the actual fuel pressure is higher than the target fuel pressure, the designated fuel pressure is only required to be made lower than the target fuel pressure, and when the actual fuel pressure is lower than the target fuel pressure, the designated fuel pressure is only required to be made higher than the target fuel pressure. The control apparatus 60 conducts this processing in below-described designated fuel pressure correction control. FIG. 6 is a flowchart showing a control flow of the designated fuel pressure correction control executed by the control apparatus 60.

In the control flow of the designated fuel pressure correction control, first, at step S11, it is determined whether the upon-stopping fuel pressure control is underway. When the upon-stopping fuel pressure control is not underway, this control is finished. In addition, even when the upon-stopping fuel pressure control is underway, because after the engine 10 has been stopped, the high pressure fuel pump 26 cannot be operated in accordance with the designated fuel pressure, this control is finished.

When the upon-stopping fuel pressure control is underway and the high pressure fuel pump 26 is in operation, at step S12, it is determined whether there is a difference between the actual fuel pressure and the upon-stopping target fuel pressure. When there is not a difference of a predetermined value or more therebetween, this control is finished. The predetermined value used for the determination corresponds to a deviation amount of fuel pressure allowable in light of the PM emission amount and the startability.

When there is the difference of the predetermined value or more between the actual fuel pressure and the upon-stopping target fuel pressure, at step S13, the fuel pressure designated for the high pressure fuel pump 26 is gradually changed. Specifically, when the actual fuel pressure is higher than the upon-stopping target fuel pressure, in accordance with the difference, the designated fuel pressure is gradually changed to shift from the upon-stopping target fuel pressure to a side of low fuel pressures. Conversely, when the actual fuel pressure is lower than the upon-stopping target fuel pressure, in accordance with the difference, the designated fuel pressure is gradually changed to shift from the upon-stopping target fuel pressure to a side of high fuel pressures. By performing the above-described control in combination with the upon-stopping fuel pressure control, even when the fuel supply apparatus 20 has the aged deterioration or the individual variability, it is made possible to bring the actual fuel pressure in the state in which the engine 10 is intermittently stopped close to the upon-stopping target fuel pressure.

3. Other Embodiment

In the above-described embodiment, the high pressure fuel pump 26 is engine driven type. However, the high pressure fuel pump 26 may be an electric pump. For example, the high pressure fuel pump 26 may be an electric pump to which electricity is supplied from a battery 44. When the high pressure fuel pump 26 is the electric pump, even after the engine 10 has been stopped, in accordance with a vehicle speed, a hydraulic pressure can be adjusted. A vehicle speed referenced in this case may also be a vehicle speed in the state in which the engine 10 is intermittently stopped.

The hybrid system 4 according to the above-described embodiment is the parallel hybrid system. However, the embodiment of the present disclosure is applicable to the so-called series-parallel hybrid system. Also in the series-parallel hybrid system, an internal combustion engine has a direct injection injector, fuel is injected from the direct injection injector, and the internal combustion engine is started from a state in which the engine is intermittently stopped.

What is claimed is:

1. A hybrid vehicle comprising:

an internal combustion engine having a direct injection injector; and a fuel pump configured to generate a fuel pressure for fuel supplied to the direct injection injector in accordance with an operation state of the internal combustion engine, a controller configured to start, by injecting the fuel from the direct injection injector, the internal combustion engine from a state in which the internal combustion engine is intermittently stopped, wherein the controller is configured to operate the fuel pump so as to increase an upon-stopping fuel pressure in accordance with an increase in an upon-stopping vehicle speed, the upon-stopping fuel pressure being a fuel pressure in the state in which the internal combustion engine is intermittently stopped, the upon-stopping vehicle speed being a vehicle speed upon intermittently stopping the internal combustion engine.

2. The hybrid vehicle according to claim 1, wherein a lowest fuel pressure is set for the upon-stopping fuel pressure, and the controller is configured to operate, when the upon-stopping vehicle speed is less than or equal to a predetermined vehicle speed, the fuel pump such that the upon-stopping fuel pressure becomes the lowest fuel pressure, and to operate, when the upon-stopping vehicle speed is higher than the predetermined vehicle speed, the fuel pump such that the upon-stopping fuel pressure is increased so as to be higher than the lowest fuel pressure in accordance with an increase in a degree to which the upon-stopping vehicle speed is higher than the predetermined vehicle speed.

3. The hybrid vehicle according to claim 1, wherein the fuel pump is configured to change a fuel pressure in accordance with a designated fuel pressure, and the controller is configured to obtain an actual fuel pressure in the state in which the internal combustion engine is intermittently stopped, and to correct, when there is a difference between a target value of the upon-stopping fuel pressure and the actual fuel pressure, the designated fuel pressure so as to bring the actual fuel pressure close to the target value.

4. The hybrid vehicle according to claim 1, wherein the fuel pump is driven by the internal combustion engine, and upon intermittently stopping the internal combustion engine, the controller is configured to stop the internal combustion engine after having raised the fuel pressure up to the upon-stopping fuel pressure from a fuel pressure in a state in which the internal combustion engine is idling.

* * * * *